US006782878B2

(12) United States Patent
Spix

(10) Patent No.: US 6,782,878 B2
(45) Date of Patent: Aug. 31, 2004

(54) PCV ASSEMBLY AND FITTING

(75) Inventor: Thomas A. Spix, Rochester Hills, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/445,628

(22) Filed: May 27, 2003

(65) Prior Publication Data

US 2004/0144373 A1 Jul. 29, 2004

Related U.S. Application Data

(60) Provisional application No. 60/442,961, filed on Jan. 27, 2003.

(51) Int. Cl.[7] ..... F01D 25/02
(52) U.S. Cl. ..... 123/572
(58) Field of Search ..... 123/572, 573, 123/574

(56) References Cited

U.S. PATENT DOCUMENTS 4,205,642 A * 6/1980 Nishimura et al. ..... 123/574
5,884,612 A * 3/1999 Takeyama et al. ..... 123/572
6,234,154 B1 * 5/2001 Spix ..... 123/572
6,405,721 B1 * 6/2002 Moren ..... 123/572
6,601,572 B2 * 8/2003 Okamoto ..... 123/572

* cited by examiner

*Primary Examiner*—Marguerite McMahon
(74) *Attorney, Agent, or Firm*—Leslie C. Hodges

(57) ABSTRACT

A PVC assembly includes a tubular fitting which significantly reduces the possibility of vapors freezing so as to block the PCV passage entry into a manifold. The fitting may be a material, such as nylon, with low heat conductivity as compared to a metal fitting and which is thermally isolated by an air gap from the PCV inlet opening of an aluminum metal manifold to minimize heat loss to the manifold walls. A mounting portion of the fitting includes a primary seal and a secondary seal/retainer that provides backup sealing and also acts as a snap-in retainer that releasably holds the fitting in the manifold PCV inlet opening without further retaining means. A simplified inlet fitting with both retaining and heat conserving features is thereby provided.

13 Claims, 4 Drawing Sheets

PCV ASSEMBLY AND FITTING

This application claims priority from U.S. Provisional Application Serial No. 60/442,961 filed Jan. 27, 2003.

TECHNICAL FIELD

This invention relates to positive crankcase ventilation (PCV) systems for engines and, more particularly, to a PCV assembly and fitting for improving the assembly and operation of a PCV system.

BACKGROUND OF THE INVENTION

It is known in the art to provide positive crankcase ventilation (PCV) systems for internal combustion engines to draw crankcase vapors from the engine crankcase into an intake air passage, such as in an intake manifold, and conduct the crankcase vapors with the air into the engine cylinders for burning and disposal through the engine exhaust emission control system. Ventilation of engine crankcases is desirable to remove water and fuel vapors as well as combustion byproducts which may accumulate in the crankcase during normal engine operation. Positive ventilation systems are desirable since they assure adequate crankcase ventilation while disposing of the crankcase vapors in the engine cylinders. There, substances such as hydrocarbons and combustion products are burned and treated with the engine exhaust gases prior to being released into the atmosphere.

A typical PCV system may include a PCV control valve or orifice mounted in a rocker cover or other suitable portion of the engine which communicates with the engine crankcase. The PCV valve or outlet fitting is connected by a tube or hose with a tubular connector or other suitable fitting communicating with the interior of the engine intake manifold, or another portion of the engine air intake system in which a vacuum is developed by throttling the intake. During engine operation, the vacuum developed in the manifold or other component draws crankcase vapors through the PCV system and fitting into the manifold where it is mixed with the intake air and delivered to the engine cylinders for burning with the fuel supplied by the engine fuel system.

When the engine is operated in very cold ambient temperatures, water that has accumulated in the engine oil and crankcase will vaporize and condense in the PCV system passages. The condensate may collect in the PCV passage where the delivery fitting enters the manifold due to loss of heat from the crankcase vapors to the fitting which is cooled by the walls of the manifold exposed to below freezing temperatures of the intake air. If the frost builds up in the passage it may become blocked, preventing the normal operation of the PCV system in disposing of crankcase vapors through the engine induction system and cylinders.

Various devices have been utilized to avoid frost build up and blocking of the PCV system. These include heating sensitive portions of the PCV passages with engine coolant in a heat transfer device, using electrical heaters to heat the PCV fitting or valve or to raise the temperature of the vapor in the PCV system, and utilizing a heat conductive strap wrapped around the PCV tube to conduct heat from the cylinder head to the tube. These solutions, while effective, add complexity to the design and installation of the engine PCV system as well as adding to its cost.

SUMMARY OF THE INVENTION

The present invention provides an improved PVC assembly and fitting which significantly reduces the possibility of vapors freezing so as to block the PCV passage. This is accomplished by using a plastic material, such as nylon, which has very low heat conductivity as compared to a metal fitting and which is also thermally isolated from the PCV inlet opening of the aluminum metal manifold to reduce heat loss from the fitting to the cold walls of the manifold.

A further feature of the invention is the use of a double seal arrangement on the fitting. A first O-ring seal in a groove of the fitting slides into a smooth portion of an inlet opening in the manifold PCV passage to seal against leakage around the body of the fitting. A second O-ring seal is mounted on a slightly larger diameter portion of the fitting and expands into a groove provided in the inlet opening of the manifold PCV passage as well as being held in a groove of the fitting. This second seal acts as an additional back-up seal as well as providing a snap in attachment for the fitting within the PCV inlet opening of the manifold. The seal also acts to retain the fitting within the inlet opening subject to removal by pulling on the fitting with a sufficient force. This feature provides quick connection of the PCV fitting to the manifold as well as allowing removal for service or replacement without requiring a separate fastener for attaching the fitting to the manifold.

An isolated portion of the fitting extends into the manifold air passage so that the crankcase vapors entering the air stream are not cooled excessively by adjacent portions of the manifold wall. Accordingly, freezing of the vapors within the PCV fitting is avoided and the PCV passage remains free for the flow of crankcase vapors.

These and other features and advantages of the invention will be more fully understood from the following description of certain specific embodiments of the invention taken together with the accompanying drawings.

DESCRIPTION OF THE PREFERRED EMBODIMENT

Figure 1:
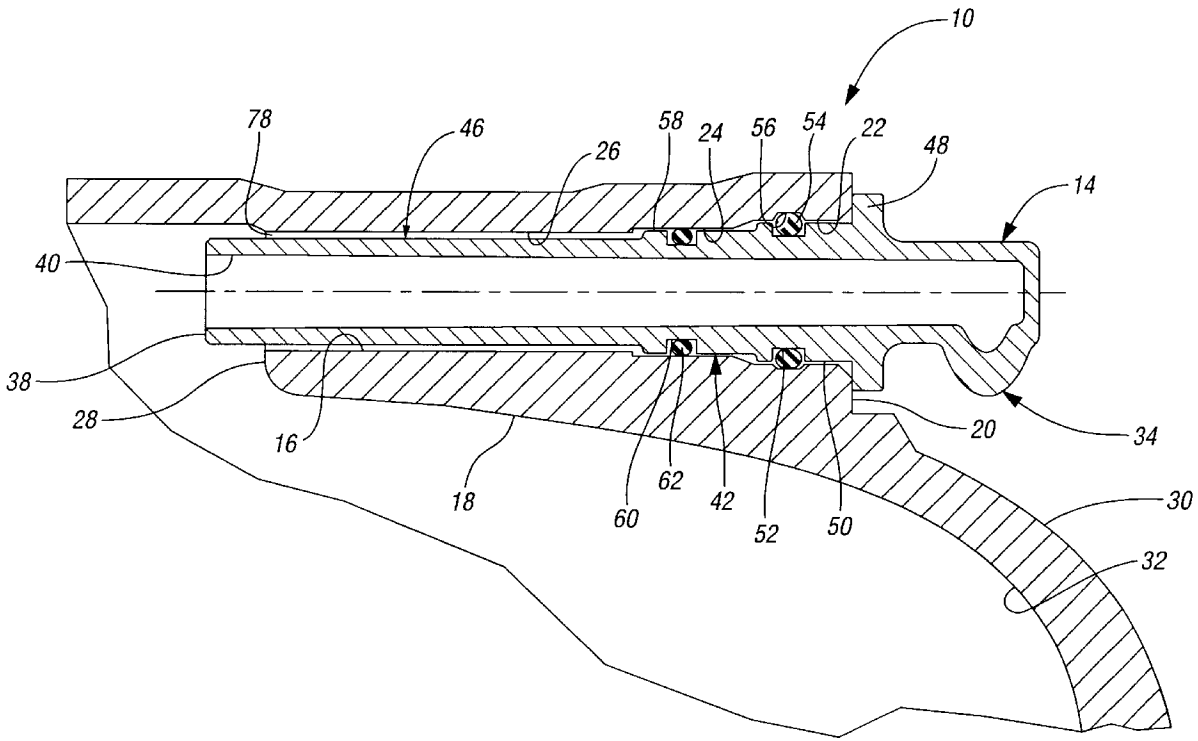
FIG. 1 is a cross-sectional view through a portion of an engine intake manifold and an associated PCV fitting formed in accordance with the invention.
Figure 2:
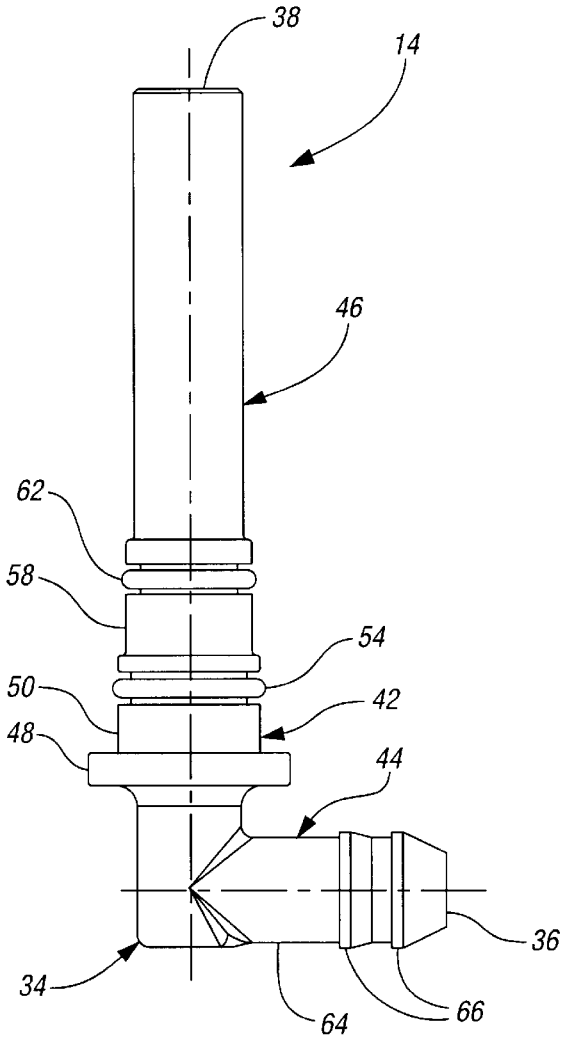
FIG. 2 is a side view illustrating the external side configuration of a connecting portion of the fitting of FIG. 1.
Figure 3:
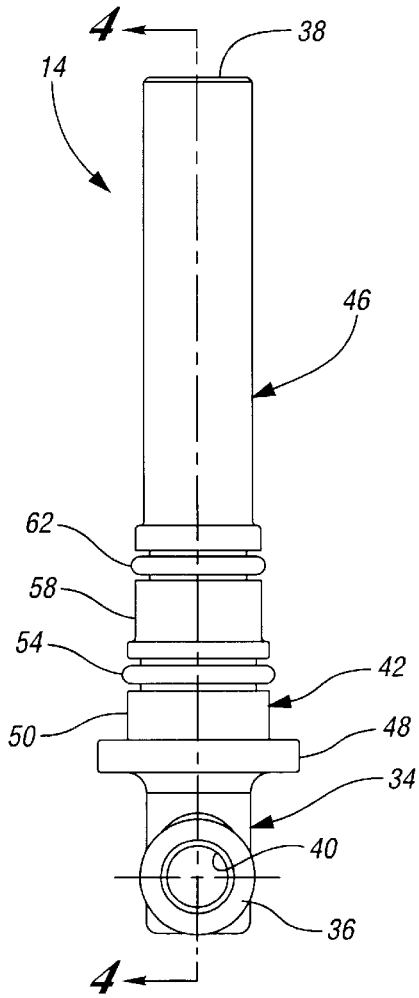
FIG. 3 is a side view of the fitting of FIG. 2 showing an end view of the connecting portion.
Figure 4:
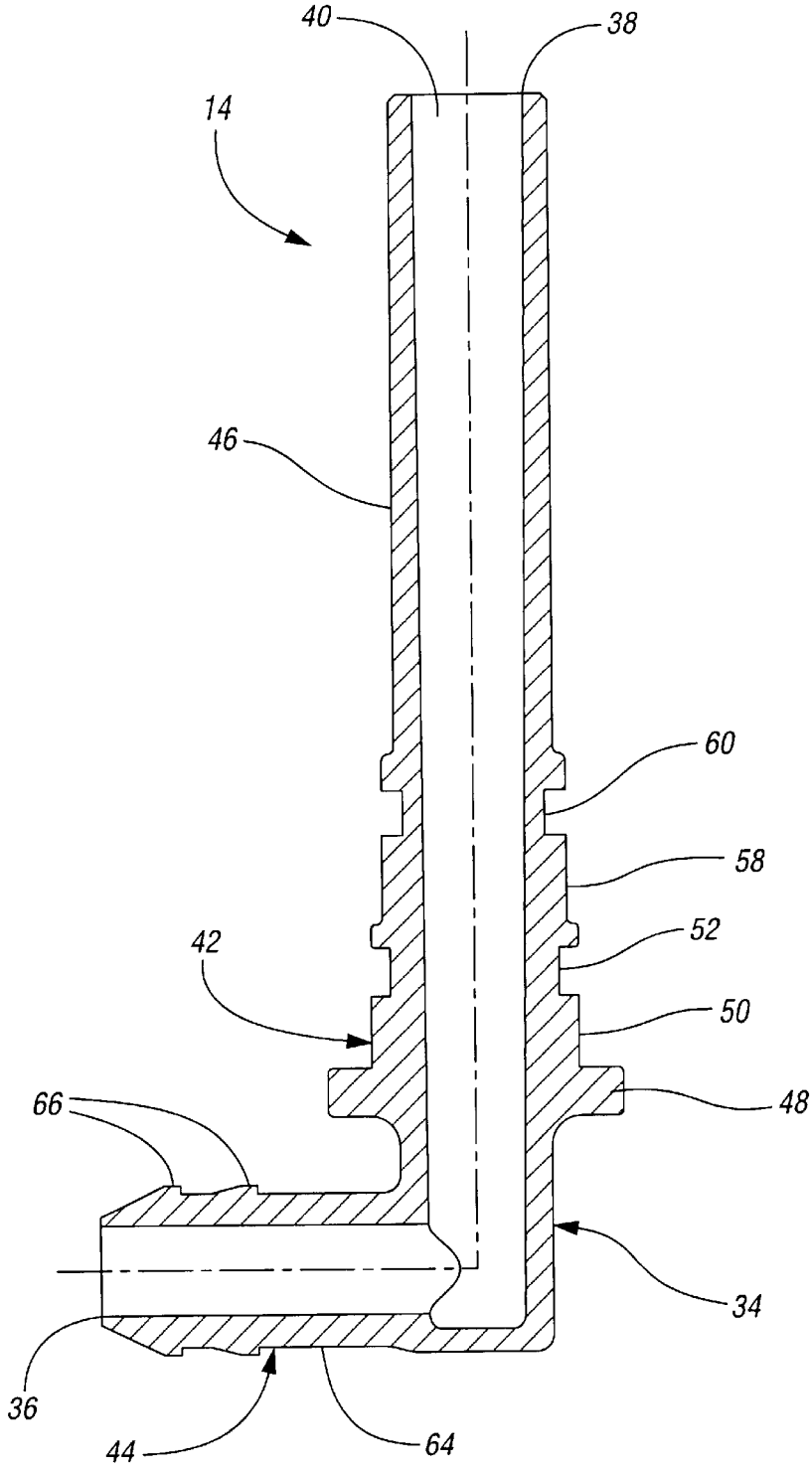
FIG. 4 is a cross-sectional view from the line 4—4 of FIG. 3.

Referring now to the drawings in detail, numeral 10 generally indicates a portion of a PCV assembly including an aluminum engine air intake manifold 12 having assembled therewith a PCV fitting 14.

In the illustrated embodiment, the PCV fitting 14 is mounted in a relatively long inlet opening 16 in a PCV mounting boss 18 of the manifold 12. The use of the relatively long inlet opening is caused in part by the available space outside the manifold for connection to the PCV fitting. Thus, it should be understood that, in other applications, the fitting could be mounted in a thinner portion of the manifold wall so that a much shorter body of the fitting could be utilized.

The inlet opening 16 originates at a machined face 20 and includes in series an enlarged mounting bore 22, a slightly smaller sealing bore 24 and a still smaller isolation bore 26, which extends to an inner end 28 of the PCV boss 18. The boss 28 is cast integral with an exterior wall 30 of the manifold 12, which internally defines an air intake passage 32 through which air is delivered to engine cylinder intake ports, not shown, leading to the engine cylinders, not shown.

Referring now to FIGS. 1–4, the PCV fitting 14 includes a tubular body 34 including an inlet end 36 and an outlet end 38 and defining an internal fluid passage 40 between the inlet and outlet ends. The body 34 is formed of a heat and oil resistant plastic suitable for use in a PCV system. Forms of nylon are examples of materials which may be suitable for particular applications of fittings according to the invention. However, any suitable plastic materials may be utilized.

The body 34 of the PCV fitting 14 includes a mounting portion 42, a connecting portion 44 and an isolating portion 46.

The mounting portion includes a flange 48 which, in assembly, engages the mounting face 20 of the manifold 12. A relatively large mounting diameter 50 extends longitudinally from the mounting flange and, in assembly, extends in close fitting relation with the mounting bore 22 of the PCV inlet opening 16 of the manifold. A retaining groove 52 in the mounting diameter carries an O-ring seal and retainer member 54 which is received in an internal groove 56 of the mounting bore 22. The seal 54 expands into the groove with a snap like motion upon assembly and acts to releasably retain the fitting 14 within the mounting bore 22 of the intake manifold 12.

Inwardly adjacent to mounting diameter 50, fitting 14 includes a reduced diameter sealing portion 58 carrying an external groove 60 in which is carried a primary O-ring seal 62. Seal 62 engages the smooth sealing bore 24 of the manifold to act as a primary seal preventing any transfer of gases between the interior of the manifold and the atmosphere external to the manifold.

Inwardly adjacent the sealing portion 58, is the isolating portion 46 of the fitting 14. Portion 46 is axially cantilevered from the mounting portion 42 and has an outer diameter slightly less than the sealing portion 58. The isolating portion 46 extends though the end 28 of the PCV inlet opening 16 and into the air intake passage 32 in which intake air flows during operation of the engine.

Figure 5:
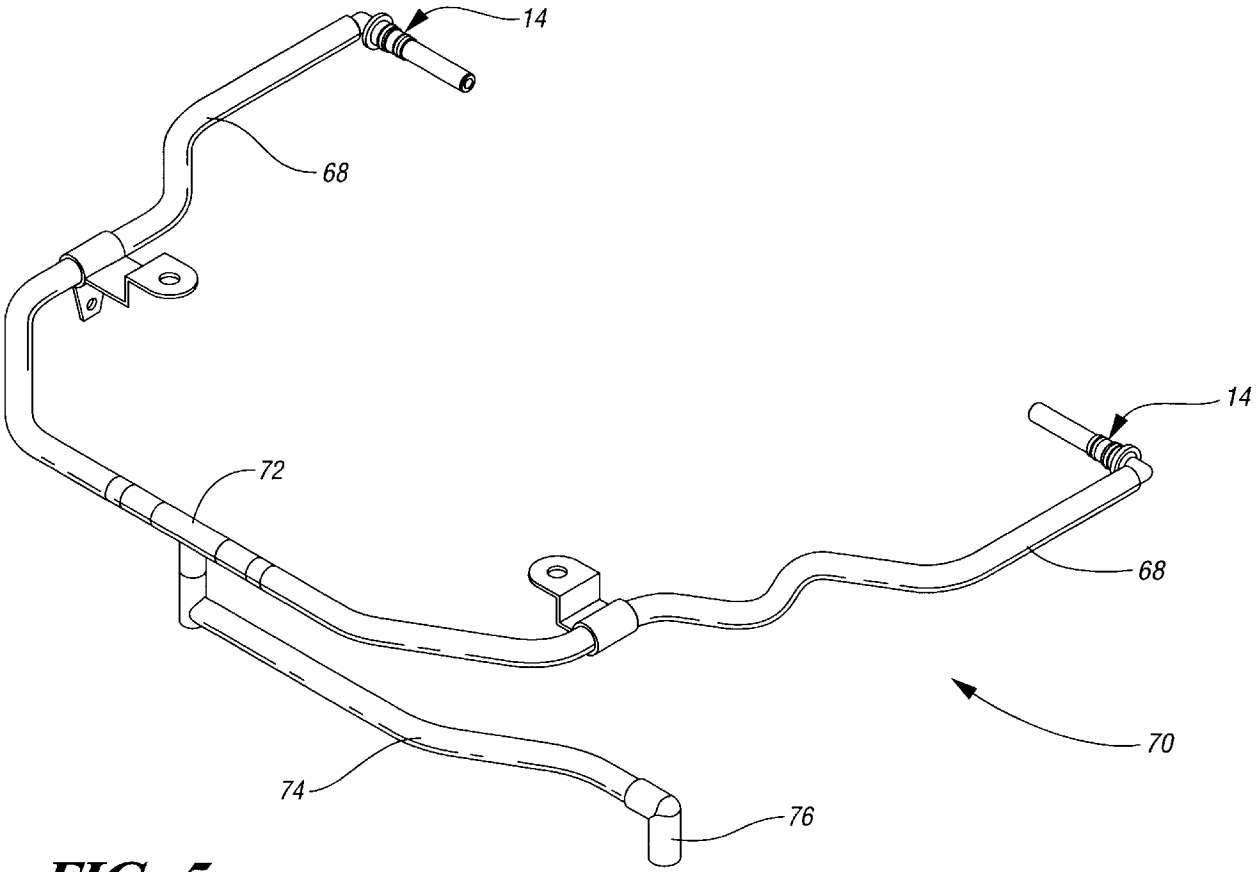
FIG. 5 is a pictorial view of a PCV connecting harness shown connected with PCV fittings in accordance with the invention.

At the inlet end 36 of the fitting 14 is the connecting portion 44 which extends axially outward from the flange 48 and turns at a right angle to an external cylindrical portion 64, terminating adjacent the end 36 with a pair of spaced raised mounting rings 66. The cylindrical portion 64 and mounting rings 66 are adapted to be press fitted into tubular arms 68 of a PCV harness 70 illustrated in FIG. 5. Harness 70 is shown as only one of many examples of harnesses and conducting tubes which could be connected between one or more PCV fittings 14 and an associated engine crankcase.

The tubular arms 68 of harness 70 form conduits that are joined by a T-connector 72 which in turn connects with an inlet pipe 74 and elbow 76. The components of the harness 70 are preferably formed of temperature and oil resistant plastic material such as nylon. The elbow 76 is adapted to be fitted onto a PCV valve or orifice adapter, not shown, which is connected in the PCV system with the engine crankcase, not shown.

The extended cylindrical isolating portion 46 of the PCV fitting 14 is sized to define an air gap 78 between the isolation bore 26 of the manifold and the outer diameter of the isolating portion 46 of the PCV fitting. The air gap provides isolation of the terminal portion of the fitting from the manifold inlet opening 16 through which the fitting extends and thus increases the resistance to heat transfer from the fitting to the manifold.

In use of the disclosed embodiments of the invention in association with a particular model of engine, two PCV fittings are provided for assembly into separate inlet openings provided on opposite sides of the manifold which connect with separate air passages 32 within the intake manifold 12. The O-rings 54 and 62 of each fitting 14 are installed in their respective grooves by sliding them onto the body 34 from the outlet end of the isolating portion 46.

The fittings 14 may then be slid into their respective inlet openings of the intake manifold as shown in FIG. 1. The O-ring seal/retainers 54 are snapped into the retaining grooves 52 of the manifold mounting bores 22 and the primary O-ring seals 62 are positioned in engagement with the sealing bores 24 of the manifold while the isolating portions 46 of the fittings extend in spaced relation from the isolation bores 26, being separated by the air gap 78.

The PCV harness 70 is then installed with the tubular arms 68 being pushed onto the connecting portions 44 of the two fittings 14. The mounting rings 66 provide means by which the expanded plastic tubes of the arms 68 are retained on the connecting portions 44 of the fittings 14. Elbow 76 may then be connected with an associated PCV valve or other fitting in order to complete the PCV system for the engine.

If desired, alternative assembly steps could be utilized wherein the PCV harness 70 is assembled in individual sections or wherein the PCV fittings 14 are installed on the harness 70 before assembly into the intake manifold.

In operation of the engine, not shown, intake air is drawn into air intake passages 32 of the manifold and may be throttled to form a vacuum. The vacuum draws crankcase gases from the engine crankcase through the harness 70 into fittings 14. The gases then pass through the passages 40 in the connecting, mounting and isolating portions of the fittings to enter the air stream at the outlet ends 38 of the fittings which extend beyond the ends 28 of the manifold bosses 18.

In extremely cold weather, the aluminum intake manifold walls reach below freezing temperatures. However heat transfer from the warmer crankcase vapors passing thorough the fittings 14 is resisted by the low thermal conductivity of the plastic fittings 14 as well as by the air gaps 16 which isolate the outlet ends of the fittings from the adjacent manifold walls. Thus, the crankcase vapors passing into the intake air stream are not sufficiently cooled to form ice crystals or frost from the water vapor in the crankcase vapors. Plugging of the fluid passages 40 in the fittings 14 is therefore avoided and free flow of crankcase ventilation fluids is assured.

In addition, installation of the fittings with snap in motion and ease of removal by pulling outward with an adequate force provides a simplified mounting arrangement which significantly improves both the ease and the cost of assembly of the PCV harness between the engine crankcase and the intake manifold bosses. The use of the secondary seal and retainer not only provides the snap in connection of the fittings 14, but also a back-up seal against leakage of additional air into the manifold.

The illustrated embodiment shows the low conductivity fittings 14 used with an aluminum alloy intake manifold. However, the fittings may also be used with other metal manifolds as well as those made with plastic materials to reduce the possibility of icing in the PCV system and to improve assembly and servicing of the PCV systems used in engines.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A PCV fitting for connecting an engine positive crankcase ventilation (PCV) conduit with an intake air passage defined by a wall of an air intake member, the fitting comprising:

a one piece tubular body having inlet and outlet ends and defining a fluid passage extending between the ends;

the body formed of an oil and heat resistant plastic material;

a mounting portion between the ends and mountable to the wall of the air intake member;

a connecting portion on the inlet end and adapted for connection with the PCV conduit; and an isolating portion adjacent the outlet end and adapted to extend with an air gap through the wall into the intake air passage, the isolating portion being cantilevered from the mounting portion.

2. A PCV fitting as in claim 1 wherein the isolating portion has an outer diameter adapted to be spaced from the wall of the air intake conduit for limiting heat transfer from the isolating portion to the air intake conduit.

3. A PCV fitting as in claim 2 wherein the body material has significantly lower thermal conductivity than a metal manifold material.

4. A PCV fitting as in claim 3 wherein the body is made of a nylon based material.

5. A PCV fitting as in claim 1 wherein the mounting portion includes a first o-ring seal received in a first groove of the mounting portion and receivable in a smooth bore for sealing the bore against leakage of crankcase fluids.

6. A PCV fitting as in claim 5 wherein the mounting portion includes a second o-ring seal received in a second groove of the mounting portion spaced from the first groove, the second seal being receivable in a groove in the bore for snap-in retention and supplemental sealing of the fitting in the bore.

7. A PCV fitting as in claim 6 wherein the second o-ring seal is spaced toward the inlet end of the body from the first seal, the second seal being larger than the first seal and receivable in a groove in the bore for snap-in retention and supplemental sealing of the fitting in the bore.

8. A PCV fitting as in claim 1 wherein the connecting portion includes raised rings angled for push-in retention in a resilient PCV conduit.

9. A PCV (positive crankcase ventilation) assembly comprising:

an air intake conduit having a wall defining an engine air intake passage;

a boss on the wall and having an inlet opening extending therethrough into communication with the air intake passage at an inner end of the boss adjacent an isolation bore of the inlet opening; and a PCV fitting mounted in the inlet opening and extending beyond the boss into the air intake passage, the fitting having a one piece tubular body with inlet and outlet ends and defining a fluid passage extending between the ends, the inlet end adapted to receive crankcase vapors for delivery into the air intake passage;

the fitting including an isolating portion adjacent the outlet end and cantilevered from a mounting portion, the isolating portion extending within, and spaced by an air gap from, the isolation bore of the inlet opening, the air gap being effective to limit heat transfer between the isolating portion of the fitting and the wall of the air intake conduit;

the material of the body of the fitting having significantly lower thermal conductivity than a metal manifold material.

10. A PCV assembly as in claim 9 wherein the body is made of a nylon based material.

11. A PCV assembly as in claim 9 wherein the fitting includes a mounting portion having a first o-ring seal received in a first groove of the mounting portion and received in a smooth bore of the inlet opening for sealing the inlet opening against leakage of crankcase fluids.

12. A PCV assembly as in claim 11 wherein the mounting portion includes a second o-ring seal received in a second groove of the mounting portion spaced from the first groove, the second seal being received in a groove in the bore for snap-in retention and supplemental sealing of the fitting in the bore.

13. A PCV assembly as in claim 9 wherein the fitting includes a connecting portion adjacent the inlet end and including raised rings angled for push-in retention in a resilient PCV conduit.

* * * * *